United States Patent [19]

Sholly, Jr.

[11] 3,994,123

[45] Nov. 30, 1976

[54] FRICTION TWISTING HEAD

[75] Inventor: William C. Sholly, Jr., Souderton, Pa.

[73] Assignee: Turbo Machine Company, Lansdale, Pa.

[22] Filed: June 12, 1974

[21] Appl. No.: 478,599

Related U.S. Application Data

[63] Continuation-in-part of Ser. No. 405,036, Oct. 10, 1973, abandoned.

[52] U.S. Cl. ..... 57/157 TS; 57/77.4; 57/34 HS; 57/77.45

[51] Int. Cl.[2] ..... D02G 1/02

[58] Field of Search ..... 57/157 TS, 157 R, 77.4, 57/77.42, 77.45, 34 HS

[56] References Cited

UNITED STATES PATENTS

| | | | |
|---|---|---|---|
| 3,327,463 | 6/1967 | Niina et al. | 57/77.4 |
| 3,527,043 | 9/1970 | Sabaton | 57/77.4 |
| 3,685,273 | 8/1972 | Neveux | 57/77.4 |
| 3,724,196 | 4/1973 | Holland et al. | 57/77.4 |
| 3,788,057 | 1/1974 | Batsch | 57/77.4 |
| 3,811,258 | 5/1974 | Batsch | 57/77.4 X |
| 3,813,868 | 6/1974 | Lorenz | 57/77.4 |

*Primary Examiner*—John Petrakes
*Attorney, Agent, or Firm*—Paul & Paul

[57] ABSTRACT

An improved friction twisting head is provided for imparting false twist to yarn passing therethrough. The apparatus is adapted for use on existing machines. A modified form of the apparatus is adapted for allowing a running adjustment of the amount of twist being placed into the yarn as the yarn passes therethrough. On a multiple-station arrangement, this adjustment is provided at each station to allow independent control of the twist being introduced at each station.

2 Claims, 13 Drawing Figures

FRICTION TWISTING HEAD

CROSS-REFERENCE TO RELATED APPLICATIONS

This is a continuation-in-part of my U.S. application Ser. No. 405,036, filed Oct. 10, 1973, directed to *Friction Twisting Head On Conventional False Twisting Machines*, now abandoned.

BACKGROUND OF THE INVENTION

This invention pertains to apparatus for false twisting yarn, principally continuous multiple-filament synthetic yarn, such as to texturize or to impart certain physical characteristics thereto. In the type of apparatus to which the present invention in its broadest aspects in directed, such apparatus usually involves the heat setting of the false twist in the yarn, there often later being a removal of the false twist, after a cooling of the twisted yarns, such that the yarns take on a texturized, natural fiber appearance and character.

More particularly, this invention pertains to a conventional, industrially acceptable multiple-station twisting machine improved by the incorporation therein of an array of stabilized friction twisting members so that the twisting effectiveness and speed of the machine are greatly enhanced.

It is well known that synthetic yarn may be texturized or modified in its physical characteristics by false twisting the yarn and heat setting it while it is in the false twisted condition, all as the yarn is passed continuously through the false twisting and heat setting processes.

A substantial number of these existing machines impart false twist to the yarn by passing the yarn about a spindle mounted on a rotating shaft. In most cases, the spindle extends across a hollow shaft and the yarn is guided from above about the spindle and down through the vertically disposed hollow shaft to a further guide and take up means, while the spindle at each work station is held, such as by magnetic force, in engagement with discs on vertically disposed rotating shafts in frictional engagement with an endless member, such as a moving belt, passing along all of the stations of a multi-station machine. Because of the normal friction in such machines in the tortuous path that the yarn takes about the revolving spindle (often called a spindlette), these machines are necessarily limited in either the speed at which they can false twist the yarn, particularly the speed of rotation of the shaft upon which the spindle is mounted, or the effectiveness with which yarn can be false twisted at any given lineal yarn speed or both.

In U.S. Pat. No. 3,705,488, of which the present applicant is a co-inventor, an improved friction twister, consisting of an array of stabilized rotating friction twisters, was fully disclosed. This type of twister has the capability for effectively imparting a false twist, at a reasonably high rate of twist, to yarn passing through the apparatus at a relatively high velocity, such that a given level of false twist may be imparted to yarn passing through the device at a much higher speed than is possible in typical prior art false twisters, particularly including those based on a revolving spindle. However, the friction twister disclosed in U.S. Pat. No. 3,705,488 was horizontally disposed and rotation was imparted thereto by a friction driving member mounted on a shaft rotated from one end of the machine. This driving means and general disposition of the apparatus, as disclosed in U.S. Pat No. 3,705,488 is in some respects unnecessarily complex and involves a yarn path which requires that each yarn treatment station be somewhat wider than might otherwise be desired.

With this in mind, it is one general object of the present invention to enhance greatly the twisting effectiveness and the speed at which yarn can be treated in a variety of multi-station false twisting machines.

It is a more specific object of this invention to increase the speed capability of conventional revolving spindle-type multistation false twisting machines.

Additionally, multiple-station machines known in the art generally comprise a plurality of stations, and with the twist-inducer being driven at the same speed from station-to-station, either separately, or by a common driving member, such as a driving belt. Each of these stations provides a single yarn strand, and from station-to-station, it has been found that there are often very slight minor discrepancies in the degree of twist of the yarn. The reason for this can be slight differences in the yarn prior to its treatment, or can be the result of slight differences in physical structures of the twist-inducers, or as the result of wear of various parts of the twist-inducers, or otherwise, variations in the numbers of turns per lineal inch (or amount of twist) can exist.

When discrepancies exist, from station-to-station, the yarns provided thereby of course differ slightly one from the other. In constructing a fabric from these yarns, it occasionally happens that one or more of the yarns that make up a given piece of fabric have a different number of turns per inch, that results in different physical characteristics of that particular yarn from the others making up the fabric.

A principal area in which discrepancies from yarn-to-yarn is disadvantageous, is in the subsequent processing of the fabric, most especially, in the dyeing of the fabric. Yarns that have different physical characteristics, having been twisted more or less than other yarns in the fabric, and having been additionally heat-set, or otherwise additionally texturized, may absorb a greater or less amount of dye than other, for example, adjacent yarns. The result of this is that dye streaking occurs, leaving a fabric that can be unacceptable for unevenness in coloring, or having the appearance of lines located therein, in sporadic fashion, wherever yarns or yarn portions exist that have dissimilar characteristics as set forth hereinabove, from other yarns in that fabric.

Accordingly, it is an additional object of this invention to provide some means of eliminating inconsistencies in degree of twist in yarn from station-to-station.

Also, because even in a single station arrangement, in the event that twist-inducing components of a friction twister are subjected to wear during usage, it becomes desirable to provide some means for compensating for this year. It is therefore another object of this invention to provide a means for compensating for such wear, in order to provide yarn having consistent characteristics, and especially to provide yarn from a friction twister that is consistent in desired number of turns per inch, and to this end an adjustment means is provided for adjusting the amount of twist that a friction twister will apply to yarn being treated thereby.

Similarly, it is an object of this invention to provide a means whereby friction twisters at the various stations on a multiple-station machine may be periodically adjusted, by first measuring the amount of twist being applied to the yarn at the various stations, and by then making appropriate adjustments such that all stations provide the same degree of twist, for uniformity in the yarns from station-to-station.

In friction twisting devices presently available, if it is desired to compensate for wear of the devices, or to make some minor adjustment in the devices to alter the amount of twist being applied to yarn being mechanically treated thereby, it has been necessary to interrupt the operation of the friction twister, as by shutting down the machine, and then to dissassemble the devices, applying the appropriate shims, washers or the like to obtain alterations in spacing. Such manner of effecting adjustments is haphazard at best, can be time-consuming, result in lost production time, and in general is made only with substantial difficulty. Also, it has been found that in friction twisting devices presently available, yarn tension has an influence on the amount of twist being applied. From station-to-station slight differences in twist-inducing mechanisms due to tolerance discrepancies or otherwise can result in variations in yarn tension from station-to-station. These variations may or may not be acceptable, depending upon their influence on twist. Tension influence on twist can also vary with the yarn denier. The present invention allows for compensation for tension variations by adjustment of the amount of twist.

It is accordingly a further object of this invention to provide a means for effecting adjustment of the degree of twist being applied by a friction twister, during the running of the machine, without requiring disassembly.

Some of the objects set forth above are met, in accordance with the present invention by an improved multi-station machine wherein each station includes conventional yarn supply, yarn take-up and guide means, with the usual false twist stopping means, yarn heater, and yarn forwarding means with an endless member such as a belt which passes along all of the stations of the machine to impart rotary motion to a false twist spindle therein; such machine including a specific improvement to enhance false twist effectiveness and yarn speed through the machine by the incorporation therein of a friction twister consisting of a vertically disposed array of stabilized friction twisters, as specifically described hereinafter, rotated by frictional engagement of one or both of the shafts thereof with the endless member passing along all of the stations of the machine.

For meeting more specific objects of this invention, the stabilized false twisting means consists of an array of mating rotating friction twisters, and freely rotatable stabilizing anvils mounted alternatingly on a pair of vertically disposed shafts with guide means at either ends thereof so that yarn is urged into frictional engagement with the friction twisting member, and biased toward a barrier formed by the mating friction twisting members and stabilizing anvil means. Further, by virtue of the fact that each of the friction twisting members is of larger diameter than the anvil members, the yarn passing between the friction member-anvil member pairs alternatingly disposed on the shafts is urged in each case toward the friction member and toward the barrier formed by the friction members and the mating anvil member, while each of the friction members is rotated such that the moving surface thereof tends to drag the yarn away from that barrier. In this way, a highly effective false twisting means is incorporated in an existing type of machine. This constitutes a tremendous improvement in such machines by virtue of the increased speeds with which such machines can handle the yarn to be treated.

In a further preferred embodiment of the present invention, pairs of such arrays are mounted in paired stations along the length of the machine so that a much larger number of yarns can be handled in a given space.

In other embodiments of the present invention, a false twisting apparatus is provided, that utilizes a friction-applier, and a back-up-member termed an anvil, that define a yarn barrier therebetween. The yarn barrier can be a space less than the thickness of the yarn, or it can reside in the surface of the friction-applying member and the anvil or back-up-member being in surface-to-surface engagement, as desired. In some instances, it will be desired that the anvil and the friction member be in interference fit with one another, in order to assure that the barrier will provice no space for yarn to slip therethrough. In any event, in the broader aspects of some of the embodiments of this invention, some means will be provided for adjusting the amount of twist provided by the friction-inducer, preferably by adjusting the location of the barrier in such a way so to alter the yarn path through the friction twister. In additionally more specific embodiments of this invention, such alteration of the yarn path will be situated to cause the yarn to have a greater or lesser amount of contact with, or degree of wrap about the friction-applying disc, wheel or the like, such that any correspondingly greater or lesser amount of twist is applied to the yarn. Also, in the more preferred embodiments of the invention, such adjustments in degree of twist will be supplied without requiring any change in speed or the yarn twist inducer, without requiring any change in the speed of delivery of yarn along its path, and also without requiring any shut-down of the apparatus while being adjusted.

Additionally, in even more specific forms of that feature of the present invention in which a twist adjustment is provided, there will be multiple sets of friction-applying members and anvil or back-up-members, one or more of which can contain the afore-said adjustment feature, such adjustment feature being either on the friction-applying member, or on the anvil or back-up-member, but preferably being applicable to the latter.

Other objects of the present invention will be readily apparent from an understanding of the brief description of the drawing figures, the detailed descriptions of the preferred embodiments, and the appended claims.

BRIEF DESCRIPTION OF THE DRAWING FIGURES

Figure 9A:
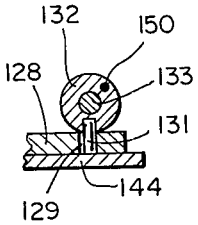
FIG. 9 is a horizontal view, taken generally along the lines 9—9 of FIG. 8, wherein certain features of the adjustment mechanism of this invention are illustrated in plan view.
Figure 9:
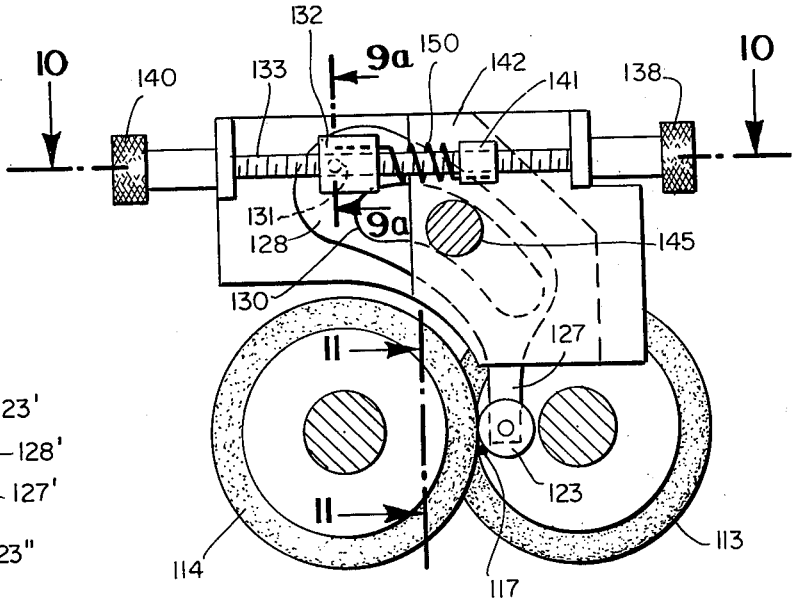

FIG. 9*a* is a transverse sectional view taken generally along line 9*a*—9*a* of FIG. 9, wherein certain components of the spring biasing of the adjustment feature are better illustrated.

Figure 10:
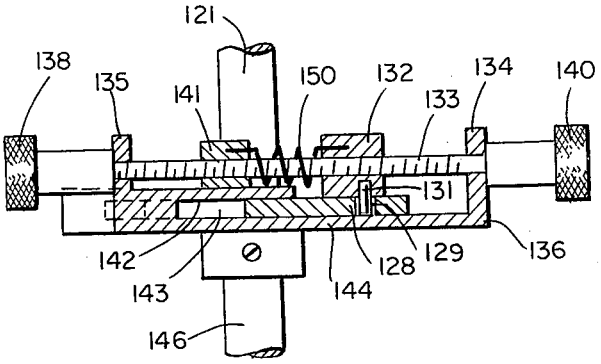

FIG. 10 is a vertical section through the adjustment feature of this invention, taken generally along the lines 10—10 of FIG. 9.

Figure 11:
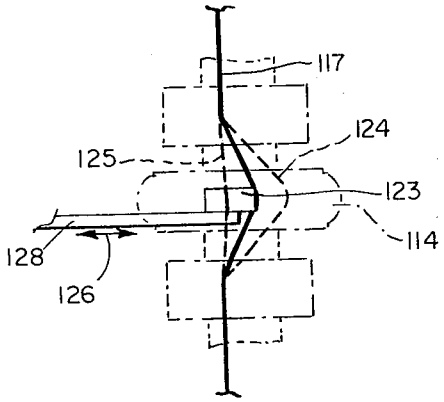

FIG. 11 is a schematic view illustrating the manner in which the barrier movement effected by adjustment of the anvil position will effect an alteration in the path of yarn movement for providing differing degrees of wrap of the yarn about the twist-inducing member.

Figure 12:
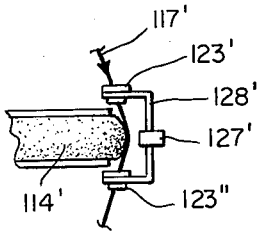

FIG. 12 is a fragmentary view of an alternative to the anvil type of back-up member.

DESCRIPTION OF THE PREFERRED EMBODIMENTS

Figure 1:
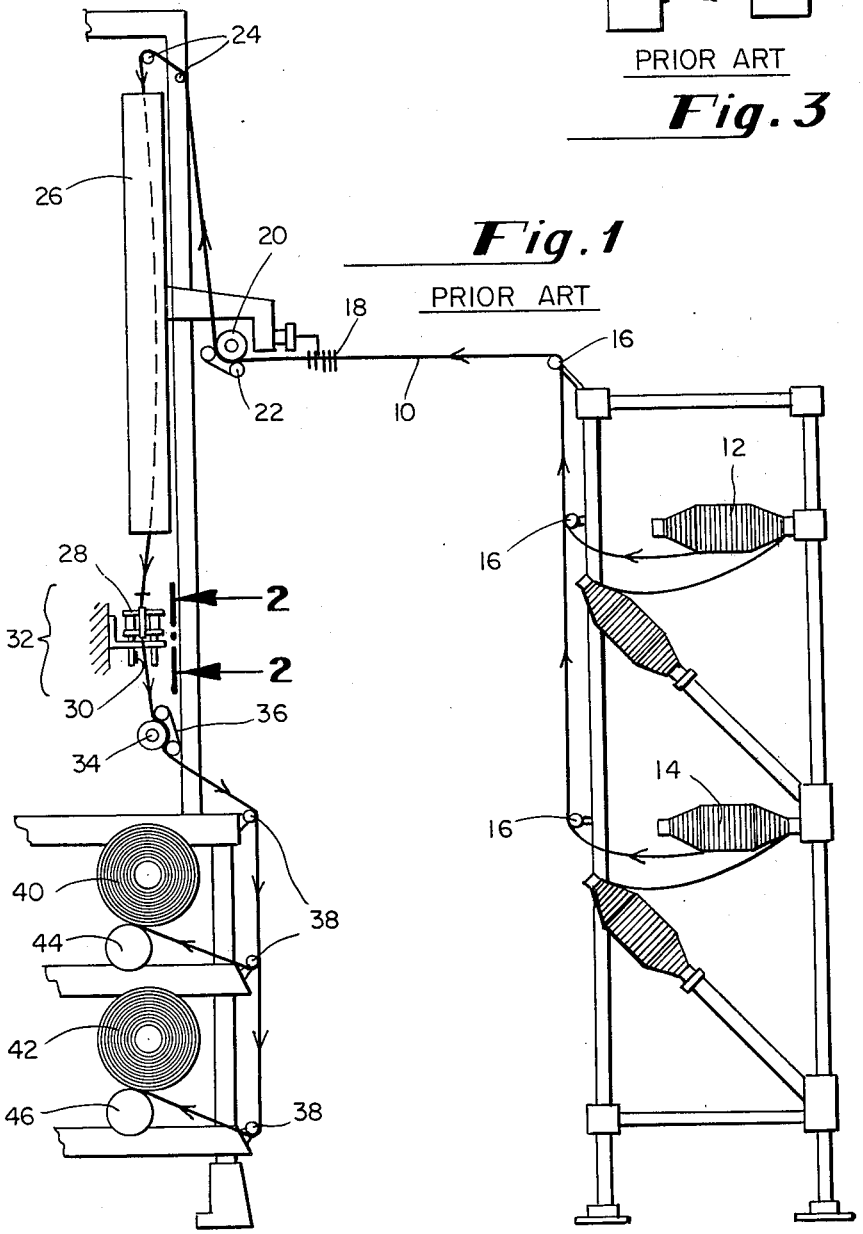
Fig. 1 PRIOR ART
FIG. 1 is a diagrammatic elevation view of a typical prior art false twisting machine.

Referring more specifically to FIG. 1, there is shown, diagrammatically, a prior art dual thread line multi-station false twisting machine of the type manufactured and sold by numerous textile equipment manufacturers, including Barmag Maschinenfabrik Aktiengesellschaft of Remscheid-Lennep, West Germany (for a description of such machines, reference is made to Volume 2 of Textured Yarn Technology, published by Monsanto Comppany in 1967). In this, the side view of a dual or paired single station of the machine, continuous synthetic yarn 10 is supplied by a dual yarn supply 12 and 14 about supply yarn guides 16 through a tensioning guide 18 to feed roll 20 including a feed roll apron 22 to heater supply guides 24, and thence an elongated heater 26. After leaving heater 26, the yarn passes through a false twist spindle head 28, described in more detail with respect to FIGS. 2 and 3, rotated by frictional engagement of a belt 30 passing along all of the stations of the machine in the vicinity of the yarn treatment space 32. Feed roll 20, feed roll apron 22 and heater supply guides 24 also provide the means for stopping false twist from backing up from spindle head 28 to yarn supplies 12 and 14. From yarn treatment space 32, the yarn passes over take up roll 34 combined with take up roll apron 36, from which the yarn passes to take up guides 38 and to dual take up packages 40 and 42 driven, respectively, by drive rolls 44 and 46.

In operation, yarn at a preselected tension controlled by tensioning guide 18 is false twisted as it passes through false twist spindle head 28. As indicated above, twist travels back in the thread line to guides 24 and possibly back to feed roll 20 where it is prevented from twisting back further in the thread line by frictional contact with these elements. Thus, the synthetic yarn, which is thermoplastic, is twisted about its axis as it passes through the elongated heater 26, which causes a slight melting or softening of the yarn so that upon cooling of the yarn as it leaves heater 26, the false twist in the yarn remains as a permanent deformation in the yarn, thus giving the yarn a textured effect.

Figure 2:
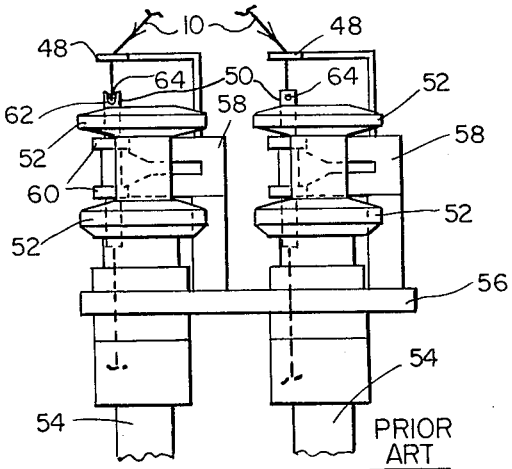
FIG. 2 is an enlarged detailed view of the false twisting head typically found in machines of the type illustrated in FIG. 1 wherein the stations of the multi-station machine are paired so that a dual thread line is passed through the twisting head shown in FIG. 2.
Figure 3:
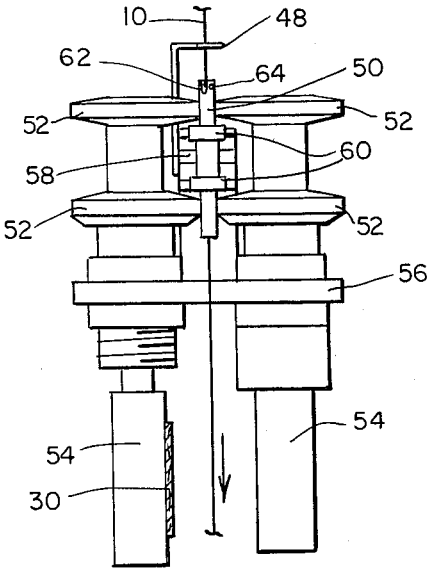
PRIOR ART Fig. 3
FIG. 3 is an enlarged detailed view of a similar false twisting head as used in an unpaired, single thread line per station machine in the prior art.

In machines of this type, in which the false twist head motion is supplied by an endless member, such as a belt 30 passing along all of the stations of the machine, the false twist spindle typically consists of, in the case of a dual thread line or paired station machine, a head as shown in FIG. 2 or, in the case of a single thread line per station machine, a head as shown in FIG. 3. In either case, the synthetic yarn 10 passes first through a spindle feed guide 48 and thence downwardly through a hollow shaft 50 at the upper end of which a horizontal member extends across the hollow shaft. Yarn 10 takes a single wrap about this horizontal member and then passes down through hollow shaft 50 and on to take up roll 34. Shaft 50 is held, such as by magnetic force, in engagement with seating and drive discs 52 in turn mounted on vertical shafts 54, one end of which includes a suitable extension positioned and dimensioned so as to engage frictionally spindle drive belt 30 (not seen in FIG. 2). Shafts 54 are otherwise suitably mounted, with bearings for free rotation, in a mounting member 56 secured to the machine frame and further including a centering guide 58 fitting about circumferential projections 60 on hollow shaft 50.

The upper design of hollow shaft 50 and the horizontal member extending across hollow shaft 50 may be better understood by reference to shaft 50 in each of the three views thereof shown in FIGS. 2 and 3, each of which is in a different point of rotation to show a configuration of the upper part of hollow shaft 50, including particularly indentation 62 therein, across which is extended horizontal member 64.

False twist spindles of the type shown in FIGS. 2 and 3 are well known and have long been used in a substantial number of industrial installations. They are, however, subject to certain inherent disadvantages, including particularly the fact that twisting is accomplished by the wrap of the yarn about a horizontal member 64 which revolves, not about its axis, but in a horizontal plane. Frictional considerations limit the speed at which the yarn can be passed through such devices and at which such devices can be rotated in a continuous reliable manner. Thus, machines of this type are limited in the speed with which yarn may be passed through the machines and in the turns per inch which can be imparted to the yarn at any given yarn speed.

Figure 6:
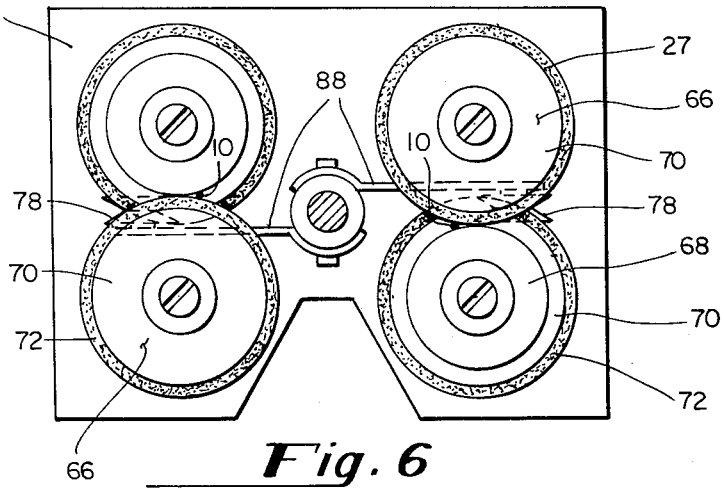
FIG. 6 is a plan view of the false twisting head shown in FIG. 4.
Figure 4:
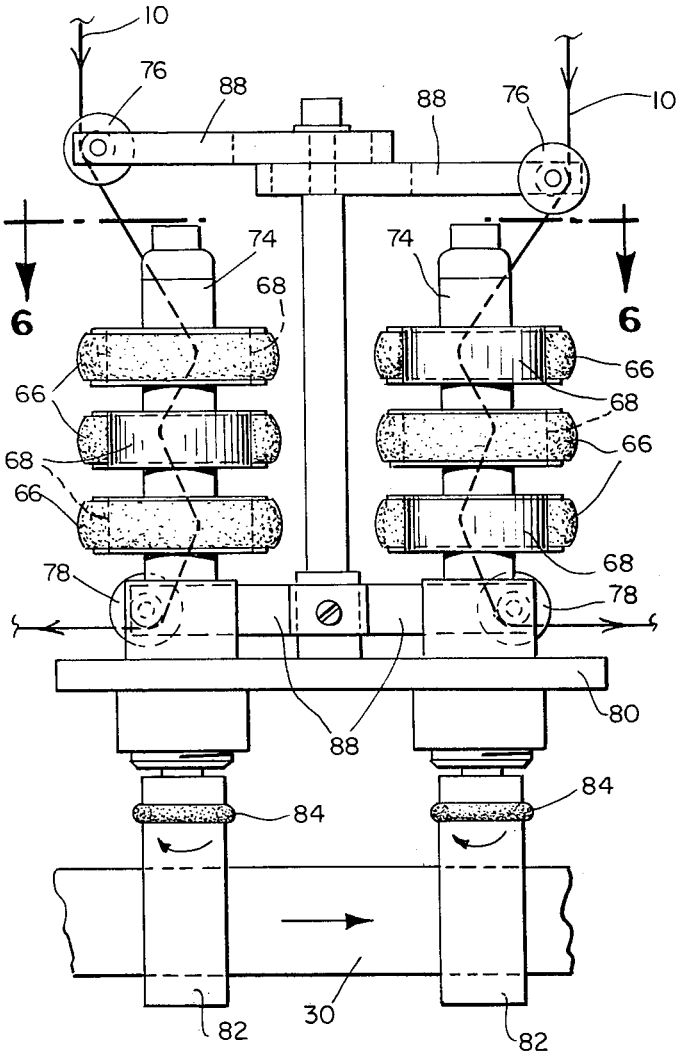
FIG. 4 is an enlarged detailed view of a dual thread line false twisting head as utilized in the improved false twisting machine of the present invention.
Figure 5:
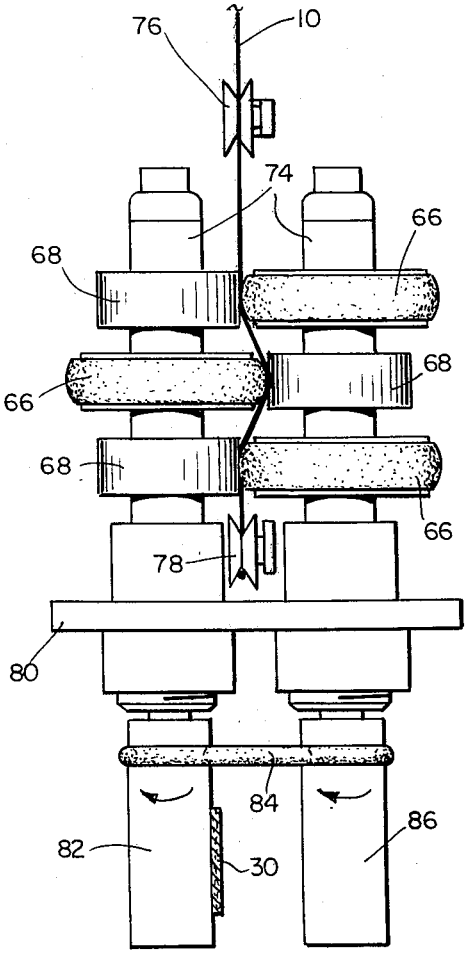
FIG. 5 is a single thread line false twisting head of the type used in the improved machines of the present invention.

In FIGS. 4 and 5, dual false twisting heads for paired or twin station machines and a single thread line head are seen, respectively. These correspond to the dual and single thread line spindles of the prior art shown in FIGS. 2 and 3. The present invention therefore encompasses a multi-station false twisting machine as shown in FIG. 1 greatly improved as to the yarn treating speed capability of the machine by the incorporation therein of friction twisting heads of the type shown in FIGS. 4 and 5. More specifically, in the dual twisting head of FIG. 4, a pair of yarns, as would be fed in a dual station or twin station machine, enter the yarn treatment space vertically and pass about guides 76 and then through the respective false twisting heads of the paired device, each of the heads consisting of an array of rotating friction twisting members 66, and mating or abutting anvil members 68. As better seen in FIG. 6, which is a plan view in the plane 6—6 of FIG. 4, each friction twisting member 66 consists of a disc 70 with a friction material 72 on its outer surface. Specifically, friction material 72 may be composed of polyurethane, synthetic rubber, ceramics, or other suitable materials.

Friction members 66 are mounted for rotation on vertically disposed shafts 74 while anvil members 68 are also mounted on vertical shafts 74 but with suitable bushings or bearings to permit free rotation thereon. Generally, each anvil member 68 is in contact with its abutting or mating twisting member 66. However, it may be possible to false twist effectively with a slight space between these elements if this is less than the diameter of the yarn to be treated so that the yarn to be treated cannot pass between the two members. Generally each twisting member 66 is also of somewhat larger diameter than that of the mating anvil members 68, the diameter of the friction members preferably having a ratio of about 5 to 4 compared to that of the anvil members 68. Upper guides 76 and lower guides 78 are disposed to control the yarn pathway and to bias the yarn as it enters and leaves the array of stabilized friction twisting members so that the yarn is held in engagement with friction members 66 and urged toward the abutment or barrier formed by the friction members 66 and the mating anvil members 68, in a manner fully described in U.S. Pat. No. 3,705,488. Shafts 74 are mounted for free rotation, in a horizontal frame member 80, below which one of the shafts includes an extension 82 frictionally engaging moving belt 30 for imparting rotational movement to the false twisting head in the improved machine of the present invention. A rubber belt 84 is disposed under tension about shaft extension 82 and about a similar extension 86 of second shaft 74 upon which mating friction members and anvil members are mounted so that the two shaft extensions in any pair of shafts in a friction twisting array are rotated in unison. In all cases, the direction of rotation is such that as the yarn is biased toward the friction members, and their abutments with mating anvil members; the friction members are rotated so that the surface movement thereof tends to drag the yarn away from the barrier or abutment of the mating friction members and anvil members.

Guides 76 and 78 are mounted on guide supports 88 in turn mounted on frame member 80.

Figure 7:
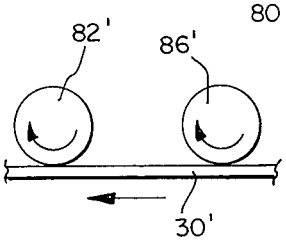
FIG. 7 is a fragmentary, bottom view of a modification of the false twisting head shown in FIG. 5.

In the modification shown in FIG. 7, the false twisting head is oriented 90° about its vertical axis with respect to the belt. In this manner, belt 30' drives both of the shaft extensions 82' and 86', thereby permitting the elimination of belt 84.

While each of the false twisting heads preferably is shown in the drawing to incorporate three sets of mating friction twisting members 66 and anvil members 68, it is to be understood that this invention contemplates the utilization of any selected number of such sets of mating members.

In operation, in the improved machines of the present invention, the inherent limitations on the speed at which twist can be imparted to a yarn and at which yarn may be passed through the false twist spindle in prior art machines has been avoided by the use of an array of stabilized friction twisting members which continuously and reliably impart a high degree of false twist to a yarn thread line moving at a velocity, which may be from 50 to 100% or greater or even less than 50%, depending on yarn denier, than that attainable in prior art machines. Thus, with very little machine modification, multi-station false twisting machines of the type now in extensive use may, with relatively small investment, be modified so as greatly to improve the production capacity of these machines.

With specific reference now to the illustrations of FIGS. 8 through 11, a modified form of the friction twisting apparatus of this invention is generally designated by numeral 100.

The friction twisting head or apparatus 100 includes a mounting member 101, and generally horizontally arranged, for mounting a pair of shafts 102, 103. The shafts 102 and 103 have lower extensions 104 and 105, respectively, with extension 104 being adapted for driving by a moving belt 106 in the same manner as the belt 30 of the embodiment illustrated in FIG. 5. A timing belt 107 is provided although the driving means can be of any suitable type, as desired, for driving the extensions 104, 105, and therefore the shafts 102, 103, in the same direction indicated by the arrows 108 and 110. Thus, the two shafts 102 and 103 are rotated in unison. It will be noted that, as is indicated in the embodiment of FIGS. 4 and 5, an additional pair of shafts may be provided, to have a double yarn twisting station, if desired. However, for the purposes of describing this particular embodiment, a single mechanical yarn treatment station is illustrated in FIGS. 8 through 11.

The shafts 102, 103 are therefore freely rotatable within bearing members 111, 112, and drive the friction-inducing discs or members 113, 114, and 115, in the directions indicated by the arrows 108 and 110.

Moving friction member 113 therefore forms a barrier with an idler disc or anvil 116 mounted for non-driven idling rotation about shaft 102. It will be noted that the members 113 and 116 form a barrier therebetween, through which the yarn 117 cannot pass, although sleeve-type hollow ceramic guide members 118 and 120 guide the yarn into a path that urges the yarn at the barrier formed by the members 113 and 116, into the barrier such that the yarn is biased toward the friction member 113 and in abutment with the mating anvil member 116. Thus, while the direction of rotation for the shafts 102 and 103 may be altered, in all instances, the direction of rotation is such that the yarn is biased toward the friction members, so that the surface movement thereof tends to drag the yarn away from the barrier formed by an associated anvil member 116.

The guides 118 and 120, which could alternatively be of the idler pulley-type illustrated in FIG. 5, if desired, are mounted respectively on a suitable post 121 carried by the horizontal member 101 and in mounting member 101. The lower end of guide 120 is provided with a balloon tube 119, also with a hollow or sleeve-like ceramic guide at the lower end thereof for passing yarn from top to bottom therethrough.

On the same shaft 103 as the friction member 113 resides, a friction member 115 resides, forming a barrier with another anvil 122.

On shaft 102, and also drivable thereby the friction member 114 forms a barrier with adjustable anvil 123.

It will be apparent that the several barriers formed herein may be a slight space, less than the thickness or diameter of the yarn 117, but preferably will not be any space, in that the friction member and its associated anvil will be in abutment, and most preferably, in interference fit one with the other.

It will be noted that the yarn 117 has a path of travel defined by the guide member 118, the guide member 120, and by the fixed barrier formed by the moving friction drive member 115 and its associated anvil 122, at the inlet of the yarn 117 to the adjustable barrier, and with the yarn path being defined at the outlet, or downstream of the adjustable barrier by the barrier formed by the movable friction member 113 and its associated anvil 116. Ordinarily, with specific reference to FIG. 11 then, the yarn path for the yarn 117 will take the form indicated by the full line yarn path illustrated. The dotted line alternatives 124 and 125, to the full line yarn path illustrated, are available depending upon the positioning of the adjustable anvil or back-up-member 123, inasmuch as the same is movable in an arcuate direction around its associated friction member or twist-inducing member 114, in the direction as indicated by the double-headed arrow 126 in FIG. 11.

The anvil member 123 comprises an idler wheel suitably carried on a carrier member or plate 127 (FIG. 9), that is an extension of a kidney-shaped plate 128 having an arcuate slotted hole 130 therein.

An infinite adjustment is provided for the plate 128, for arcuate movement about the post portion 145 that functions as a fulcrum (part of post 121), an amount permitted by the arcuate slotted hole 130. As the plate 128 is moved arcuately, the roller 123 moves into contact with a different portion of the periphery of the friction member 114, such path of adjustment of the roller 123 being generally transverse to the direction of travel of yarn 117 through the device 100.

The infinite adjustment within the limits permitted by the slotted hole 130 is provided as follows. By rotation of one or both of the thumbscrews 138, 140, the threaded member 133 also rotates. Sliding block 141 is rectangular in transverse cross-section through the threaded member 133, and therefore has a rectangular lower surface that is in sliding engagement with the upper surface of plate 128. Therefore, as the threaded member 133 is turned, the slidable mounting block 141 moves rightward or leftward as viewed in FIGS. 9 and 10, along the fitted member 133. Similarly, the sleeve-like member 132 is in threaded engagement with the threaded member 133. With particular reference to FIG. 9*a*, it will be noted that a pin 131 is in press-fit engagement in the lower periphery of member 132, with the pin 131 being in loose engagement in a clearance hole 129 in member 128. With the pin 131 so engaged between the members 132 and 128, rotation of the threaded member 133 causes travel of the sleeve-like member 132 along the threaded member 133, like the member 141, except for the "play" in rotation permitted by the loose fit of the pin 131 in the oversized hole 129. Therefore, rotation of either of the thumbscrews 138 and 140 will move both of the members 141 and 132 rightward or leftward, depending upon the direction of rotation of the threaded member 133. As the member 132 is moved either rightward or leftward, the pin 131 is also moved in a like direction, and exerts a force on kidney-shaped plate 128 that moves that portion of the plate 128 having the oversize hole 129 therein, also either rightward or leftward, in the same direction as the sleeve-like member 132, thereby causing the post portion 145 to operate as a fulcrum in engagement with another portion of the slotted hole 130, and thereby causing the adjustable anvil or roller 123 to engage the periphery of the friction member 114 at a different location as aforesaid, with respect to the description relating to FIG. 11.

Provision is also made for assuring spring type engagement of the anvil member 123 against the periphery of the friction member 114. To this end, a torsion spring 150 is provided, disposed about the threaded member 133, as illustrated in FIGS. 9 and 10, with one end in imbedded engagement in member 141, as illustrated in FIG. 10, and with the other end in imbedded engagement in sleeve member 132, also as illustrated in FIG. 10. The spring 150 is wound in such a direction, as to tend to rotate the sleeve-like member 132 in a counter-clockwise direction as viewed in FIG. 9*a*, and thereby keeps the pin 131 in tight engagement with the right side of the clearance hole 129 illustrated in FIG. 9*a*, thereby tending to provide a force on plate 128 at the location of the hole 129 that is in an upwards or lifting direction as viewed in FIG. 9, which thereby provides a clockwise force or moment of the plate 128 about the fulcrum 145, that keeps the roller or anvil 123 in spring-urged engagement against the surface of the friction member 114.

In operation, therefore, it can be seen that if it is desired to obtain an additional amount of contact of the yarn 117 with the several friction members 115, 114, and 113, and most especially with the friction member 114 that has the adjustable member 123 associated therewith as a set, one or more of the thumbscrews 138, 140 may be turned, in such a direction as will allow the anvil 123 to move in an arc about the periphery of the associated friction member 114 as allowed by plate 128 with the slotted hole 130 moving relative to pin 145, such that the barrier formed between the anvil 123 and friction member 114 is moved transversely as indicated by the double-headed arrow 126 in FIG. 11, transverse to the general solid path of travel of the yarn 117, to the position indicated by the alternative dotted line path portion 124 of FIG. 11, if desired. Conversely, if less twisting of the yarn is desired, and consequently less amount of contact of the yarn 117 about the several friction members, an appropriate rotation of the thumbscrews 138, 140, will withdraw the adjustable anvil 123 leftward as viewed in FIG. 11, such that the yarn path approaches the dotted line path portion 125 illustrated in FIG. 11. It will thus be understood that such alterations in the degree of wrap of yarn about the friction members produce corresponding alterations in the degree of yarn twist. By providing an adjustment means for each yarn 117, in a multiple-station machine, each of the yarns may periodically be measured during its running as it enters the twist-inducing member 100, and if there are discrepancies in the degree of twist being applied by the twist-inducing mechanisms, appropriate adjustments may be made by the mechanisms heretofore described, to produce yarn from the various stations having uniform degrees of twists, such that lack of uniformity that produces undesirable fabric characteristics, such as dye streaking, can be reduced or eliminated, as desired.

It will be noted, that, in accordance with this invention, either of the friction members 114, or anvil members 123 may be the adjustable component, and the result would be the same. However, because the anvil 123 is essentially an idler member, it becomes less complex to effect the adjustment by moving the member 123. However, any suitable means for moving the barrier formed thereby as indicated herein should accomplish the same result. Also, it will be noted that while in the apparatus illustrated in FIG. 8, three different sets of friction members and anvils, for forming three different barriers are indicated, in many instances it may be desired that only a single set 123, 114 could be satisfactory. Furthermore, it will be clear that, if additional adjustment is desired, the other anvils 122 and 116 could be of the type of anvil 123. Even further, additional sets of friction members and anvils, such as 4, 5 or more could be added, and as long as adjustment was provided for at least one of the friction members or anvils, the essence of this embodiment of the invention could be reproduced.

It will also be apparent that within the broad context of this invention, other means for adjusting the barrier, other than the specific threaded arrangement illustrated in FIG. 10, could be provided, but that the arrangement illustrated herein is of the best form presently known for accomplishing the purpose of allowing barrier adjustment.

Figure 8:
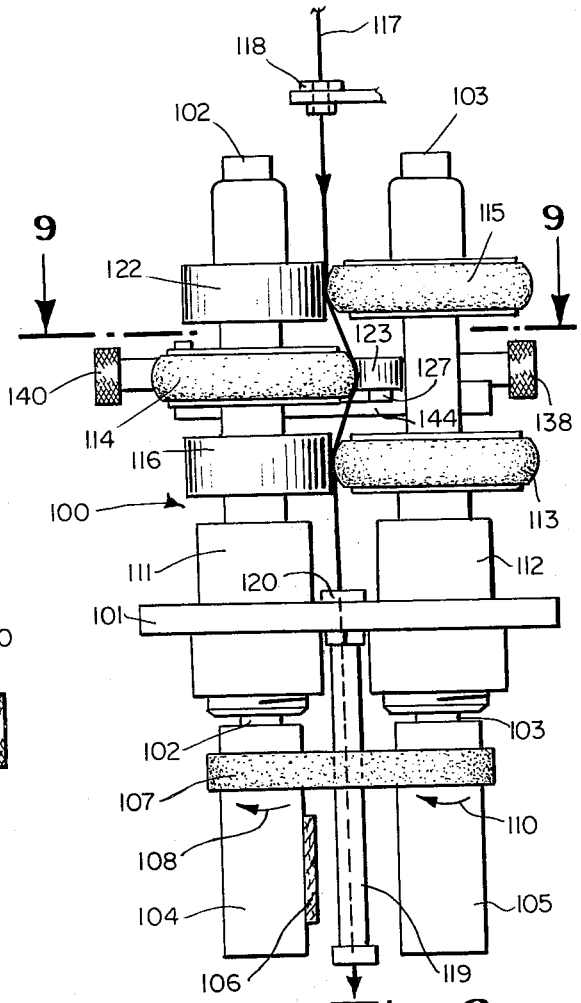
FIG. 8 is a side view of a modified form of a friction twisting head in accordance with this invention, embodying the twist adjustment feature, but otherwise is a view taken generally like that of FIG. 5.

Also, as an alternative to the anvil type of back-up member 123 illustrated in FIG. 8, an arrangement such as that illustrated in the fragmentary illustration of FIG. 12 may be provided, whereby the yarn 117' may be utilized, such being identified by the numbers 123' and 123'', positioned above and below the friction-inducing member 114'. The friction-inducing member 114' is substantially identical to that 114 illustrated in FIG. 8, as are the fixed barriers formed by the friction members and anvil type back-up members disposed above the below the friction-inducing member 114' illustrated in FIG. 12, although such fixed barrier members are not specifically illustrated in FIG. 12. The guides 123' and 123'' are preferably of ceramic construction, and being positioned above and below the peripheral surface of the friction-inducing member 114' create a yarn path for the yarn 117' that has a desired amount of contact, or degree of wrap about the surface of the member 114'.

The guides 123' and 123'' are mounted on and carried by upper and lower carrier barckets 128', that in turn are carried by an extension 127' of a kidney-shaped plate in much the same manner as the extension 127 is carried by the kidney-shaped plate of FIG. 9, although such details are not specifically illustrated in FIG. 12. The adjustment feature for moving the plate 127' through an arcuate adjustment about the periphery of the friction-inducing member 114' is also essentially the same as that adjustment feature illustrated in FIG. 9, and will not be duplicated herein. While as has been set forth above, the upper and lower sets of friction wheels and anvils would preferably be used with the arrangement illustrated in FIG. 12, in addition to the adjustable back-up device provided by the guides 123' and 123'', such is not necessarily essential with the embodiment illustrated in FIG. 12.

It will be apparent from the foregoing that the particular materials of construction and configurations of the anvils and friction surfaces may vary. For example, the material of construction of the surfaces 113, 114 and 115 may the rubber, nylon, polypropylene, ceramic, or the like, and may assume various configurations. For example, the configuration for the friction members 113, 114 and 115 is illustrated as being convex, but such could be flat as viewed in section, defining a right circular cylinder of revolution, if desired. Also, while the adjustable feature of this invention is illustrated in a machine that contemplates an essentially vertical yarn path as illustrated herein, it is to be understood that horizontally disposed yarn paths, such as that disclosed in above-mentioned U.S. Pat. No. 3,705,488 could also embody the features of the present invention as regards adjustability, as could other arrangements in which an alteration of a portion of the path of the yarn that induces a different amount of contact of yarn about a friction-inducing member be satisfactory. It will also be apparent that other modifications may be made in the details of construction, as well as in the use and operation of the devices of the present invention, all within the spirit and scope of the invention as defined in the appended claims.

What is claimed is:

1. In a yarn false twisting process, of the type in which yarn has twist applied thereto by its engagement with outer peripheral friction surface portions of rotating twist-appliers that have their axes fixedly disposed relative to each other, by friction texturing techniques, and wherein yarn travels along a predetermined longitudinal path having a lateral displacement therein that carries it into external engagement with the outer peripheral friction surface portions of the twist-appliers which continuously apply twist thereto, the improvement comprising selectively controlling the amount of twist being applied to the yarn without interrupting the continuous friction texturing, without altering the locations of axes of twist-appliers relative to each other, without requiring any change in the speed of yarn delivery along the path and without requiring any change in the speed of friction texturing, by altering the amount of contact of the yarn with an outer peripheral surface portion of a said friction-type twist applier, through selective adjustment of the amount of lateral displacement of the moving yarn in its approach to and departure from the said twist-applier.

2. The process of claim 1, wherein the selective controlling step comprises selecting a desired amount of lateral displacement of the yarn and adjusting the yarn displacement to correspond to the selection through an infinite number of potential displacement settings.

* * * * *